US005553542A

United States Patent [19]

Jackson et al.

[11] Patent Number: 5,553,542

[45] Date of Patent: Sep. 10, 1996

[54] SYSTEM FOR CONTROLLING A WEB IN A PRINTING PRESS

[75] Inventors: John C. Jackson, Preston, United Kingdom; Andrew L. Moore, Chicago; Thaddeus A. Niemiro, Lisle, both of Ill.

[73] Assignee: Rockwell International Corporation, Seal Beach, Calif.

[21] Appl. No.: 98,761

[22] Filed: Jul. 28, 1993

Related U.S. Application Data

[63] Continuation of Ser. No. 788,637, Nov. 6, 1991, abandoned.

[51] Int. Cl.[6] ..... B41F 13/02

[52] U.S. Cl. ..... 101/228; 101/181

[58] Field of Search ..... 101/181, 248, 101/228, 219, 227; 226/3, 15, 17, 19, 20, 21, 22, 23, 24, 45

[56] References Cited

U.S. PATENT DOCUMENTS

| | | | |
|---|---|---|---|
| 3,090,534 | 5/1963 | Frommer et al. | 226/21 |
| 3,147,898 | 9/1964 | Huck | 226/21 |
| 4,696,230 | 9/1987 | Barkley | 101/181 |
| 5,052,296 | 10/1991 | Shiba | 101/228 |

*Primary Examiner*—J. Reed Fisher
*Attorney, Agent, or Firm*—C. B. Patti; G. A. Montayne

[57] ABSTRACT

A control system for a web (10) in a printing press (12) having a device (20) for applying pressure to lateral locations of the web (10) intermediate side edges (22*a* and 22*b*) of the web (10), and a device (14) for controlling the pressure applying device (20) to apply a selected amount of pressure to the web (10).

4 Claims, 9 Drawing Sheets

SYSTEM FOR CONTROLLING A WEB IN A PRINTING PRESS

This is a continuation of application Ser. No. 788,637, filed Nov. 6, 1991, now abandoned.

BACKGROUND OF THE INVENTION

The present invention relates to control systems for a printing press.

In the past, a paper web has been unwound from a roll, and passed through the cylinders of a printing press for printing the web. When moisture, such as ink or other fluids, is applied to the web during printing, the web absorbs the moisture and laterally fans out, such that the side margins of the web are increased in dimensions between opposed edges of the web. Other factors which may contribute to the fanning out of the web are paper formulation, stretch, printing compression, tension, dampening fluid, and convection drying.

As a result, the web width of increased lateral dimensions may cause misregistration of the web in the printing units of the press, causing a fault in the location of inks subsequently applied to the web, such as on multi-colored printing press.

Some attempts have been made to correct the fanning out of the web. First, a rotatable wheel has been applied to a central portion of the web intermediate the side edges of the web in order to tighten the web 10. The wheel is preferably located adjacent a nip between opposed blanket rolls which apply an ink image to the web. However, it has been found that if too much pressure is applied by the wheel, the web may become ruptured, which is an undesirable result. It has also been attempted to direct a stream of air against a surface of the web to laterally shorten the web. However, both the wheels and air streams require careful adjustment by the operator in order to achieve the desired result, particularly since the devices are preferably placed very close to the nip between the blanket rolls, thus posing possible harm to the operator unless the press is stopped. Thus, these devices are tedious to use, and contribute significantly to undesirable down time of the press in order to perform these adjustments.

SUMMARY OF THE INVENTION

A principal feature of the present invention is the provision of an improved control system for a web in a printing press.

The control system of the present invention comprises, means for applying pressure to the web at a lateral location of the web intermediate opposed side edges of the web, and means for controlling the applying means to apply a selected amount of pressure to the web.

A feature of the present invention is that the system automatically corrects the lateral dimensions of the web.

Another feature of the invention is that the system prevents the necessity of making tedious adjustments of the web by an operator of the press.

Still another feature of the invention is that the system minimizes down time of the press.

Another feature of the invention is that the system minimizes the possibility of harm to an operator of the press.

Yet another feature of the invention is that the system simplifies lateral adjustments of the web.

Another feature of the invention is that the system improves the quality of the printed web in the press.

Still another feature of the invention is that the amount of pressure by the applying means may be adjusted in an automatic manner.

Yet another feature of the invention is that the modification to the width of the web is determined by the speed of the press in an automatic manner.

Another feature of the invention is that the system may have one or more sensors to detect an edge of the web, and the control system is responsive to the sensor to automatically adjust the width of the web.

Further features will become more fully apparent in the following description of the embodiments of the invention, and from the appended claims.

DESCRIPTION OF THE PREFERRED EMBODIMENTS

Figure 1:
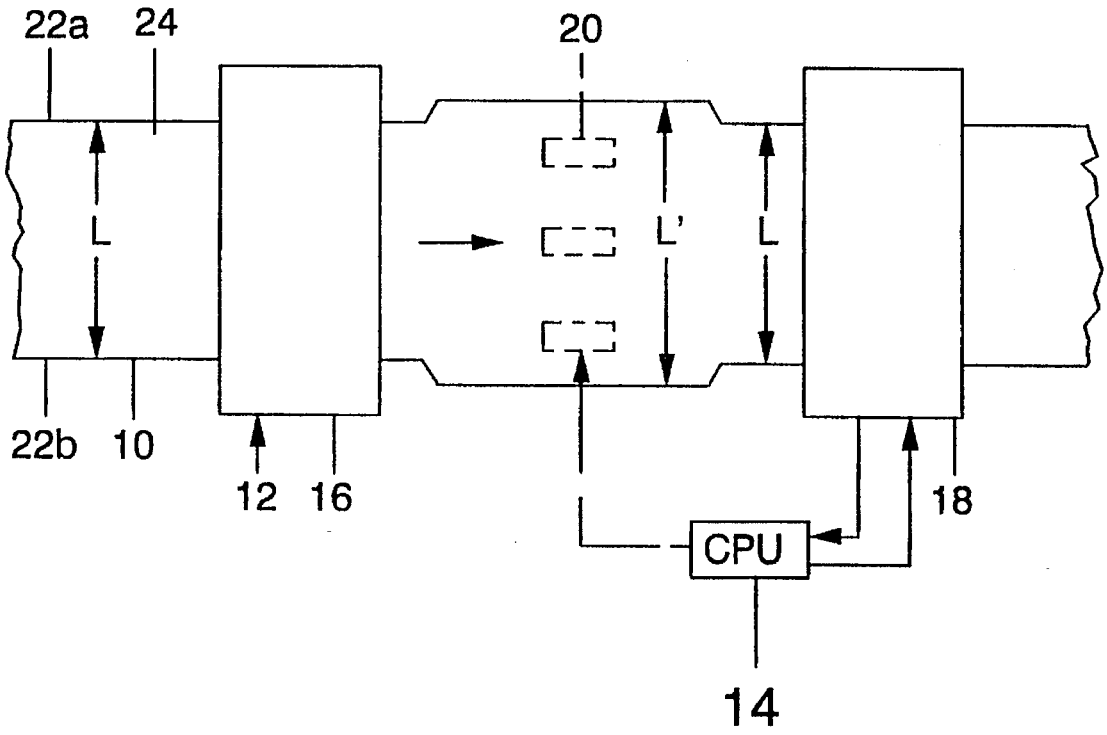
FIG. 1 is a diagrammatic view of a web in a printing press.

Referring now to FIG. 1, there is shown a paper web 10 for a printing press 12 having a control system generally designated 14 for controlling the web 10 in the press 12. As shown, the web 10 usually has a width L as it is removed from a roll for passage through the press 12. However, when moisture, such as ink or other fluids, is placed on the web 10, such as by cylinders 16 and 18 in multi-color printing units of the press 12, the moisture is absorbed by the web 10, and the web 10 laterally expands to dimensions L' which may cause misregistration of the web 10 in the press 12. Other factors which may cause fanning out of the web 10 between the lateral dimensions L and L' are paper formulation, stretch, printing compression, ink formulation, tension, dampening fluid, and convection drying. As will be seen below, the control system 14 in conjunction with a plurality of pressure members 20 spaced laterally across the web 10 between opposed side edges **20*a* and 20*b* of the web 10 reduce the lateral width of the web to the dimensions L or other desired dimensions of the web 10. The pressure members 20 are applied to a surface 24 of the web 10 which has opposed surfaces 24 and 26**.

Figure 2:
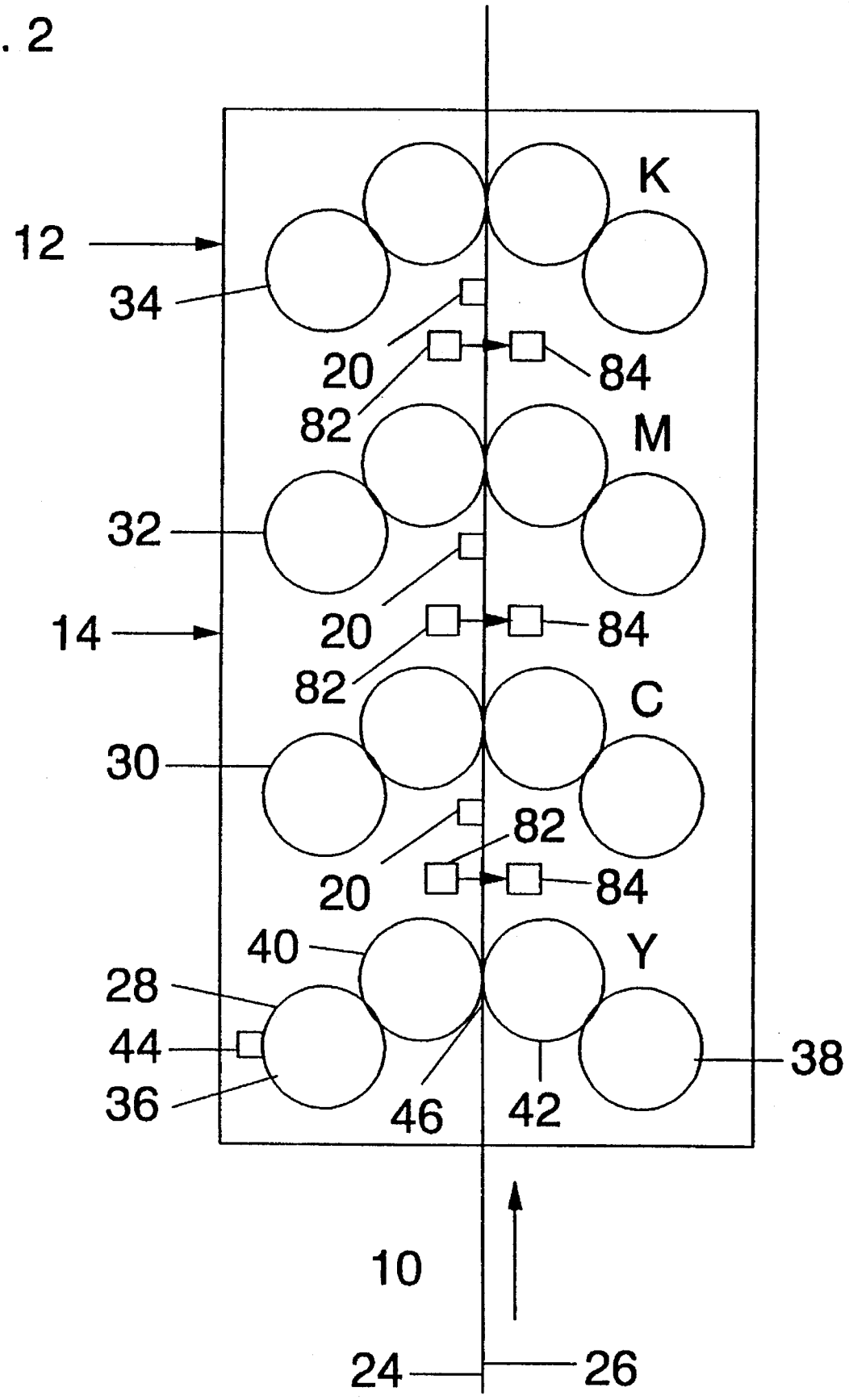
FIG. 2 is a diagrammatic view of a control system for a printing press of the present invention.

As shown in FIG. 2, the printing press 12 may have a plurality of printing units 28, 30, 32, and 34 with different colors of ink, such as yellow Y, cyan C, magenta M, and black K. Each of the printing units may have a pair of plate cylinders 36 and 38 on opposed sides of the web 10 which transfer an ink image to associated blanket cylinders 40 and 42 on opposed sides of the web 10, which in turn place the ink image onto the web 10 during printing by the press 12. The system 14 may have a suitable sensor or transducer 44 to determine the speed of the press 12. As shown, one or more of the pressure applying members 20 may be associated with a plurality of the printing units 28, 30, 32, and 34, with the pressure applying members 20 preferably being located adjacent a nip 46 of the blanket cylinders 40 and 42.

Figure 3:
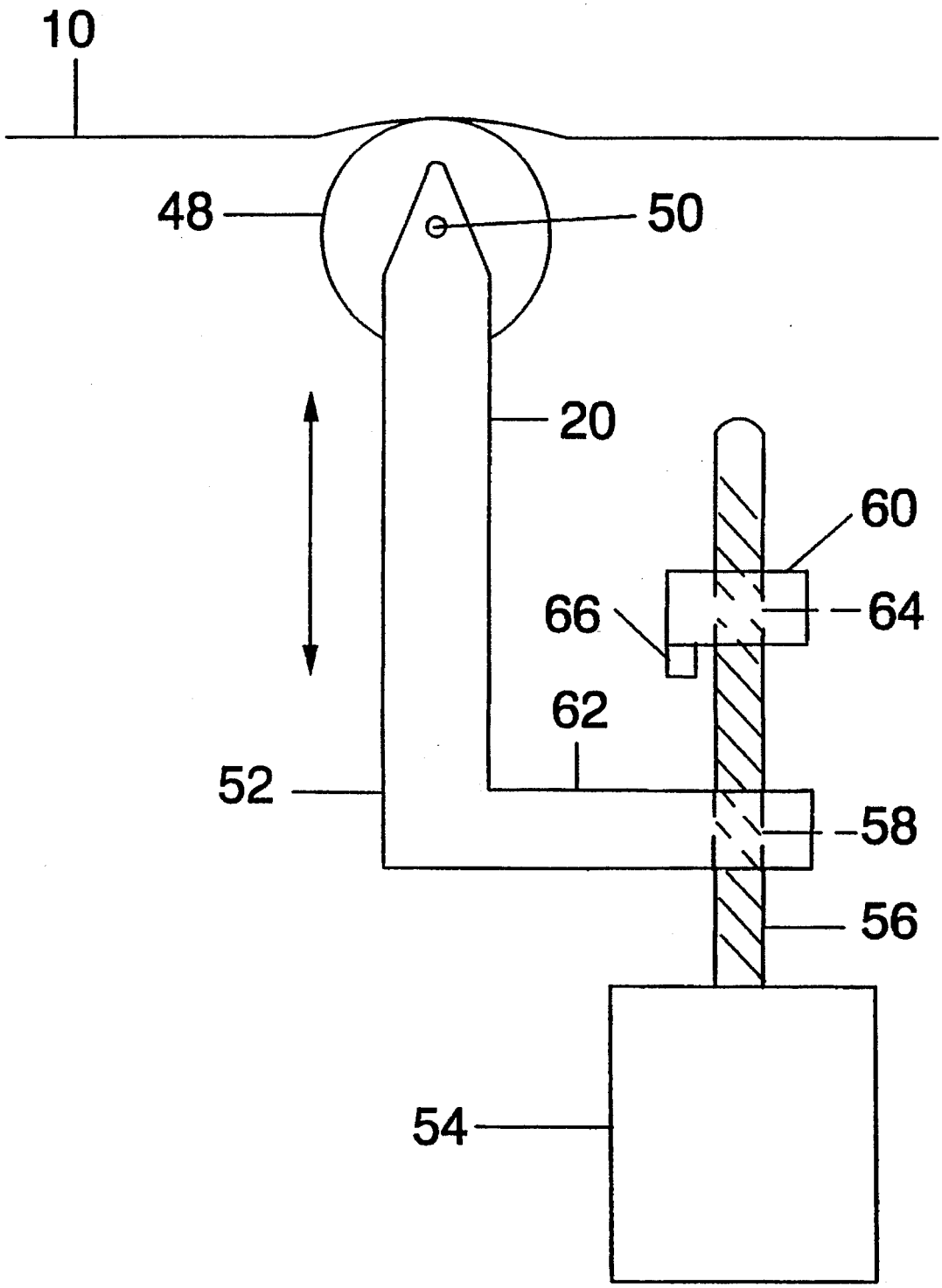
FIG. 3 is an elevational view of a rotatable wheel for making corrections to the web in the system of FIG. 2.

With reference to FIG. 3, the pressure member 20 may comprise a rotatable wheel 48 which is mounted by a pin 50 in a movable retaining member 52. The device 20 may have a suitable stepping motor 54 having a driven threaded shaft 56 which is received in a threaded bore 64 of a support member 60. The retaining member 52 has an inwardly directed arm 62 having a threaded bore 58 received on the threaded shaft 56, such that rotational motion of the shaft 56 causes linear movement of the retaining member 52 and wheel 48 in opposite directions along the shaft 56 depending upon the direction of rotation of the shaft 56. In this manner, the retaining member 52 and associated wheel 48 may be moved towards and away from the web 10 in order to apply a desired amount of pressure by the wheel 48 against then web 10. The wheel 48 thus causes a slight bowing of the web 10 at the pressure location applied to the web 10 by the wheel 48 in order to reduce the lateral dimensions of the web 10, and prevent misregistration of the web 10 relative to the printing units 28, 30, 32, and 34.

The system 14 may have a plurality of the rotatable wheels 48 of the pressure members 20 spaced laterally across the web 10, with the pressure of the devices 20 being controlled in order to reduce the lateral dimensions of the web 10 from the distance L' to a modified width L' which may be selected as the original width of the web 10 prior to printing. The amount of pressure applied by the wheels 48 may be controlled through use of the stepping motor 54 in order to prevent rupture of the web 10 by the application of excessive pressure by the wheel 48, while still reducing the side margins of the web 10 to prevent misregistration during printing. As shown, the support member 62 may have a mechanical stop 66 in order to limit movement of the retaining member 52 and wheel 48 towards the web 10, and thus prevent excessive pressure by the wheel 48 against the web 10. In an alternative form, the limit of linear movement by the wheel 48 may be controlled by a suitable computer, as will be discussed below.

Figure 4:
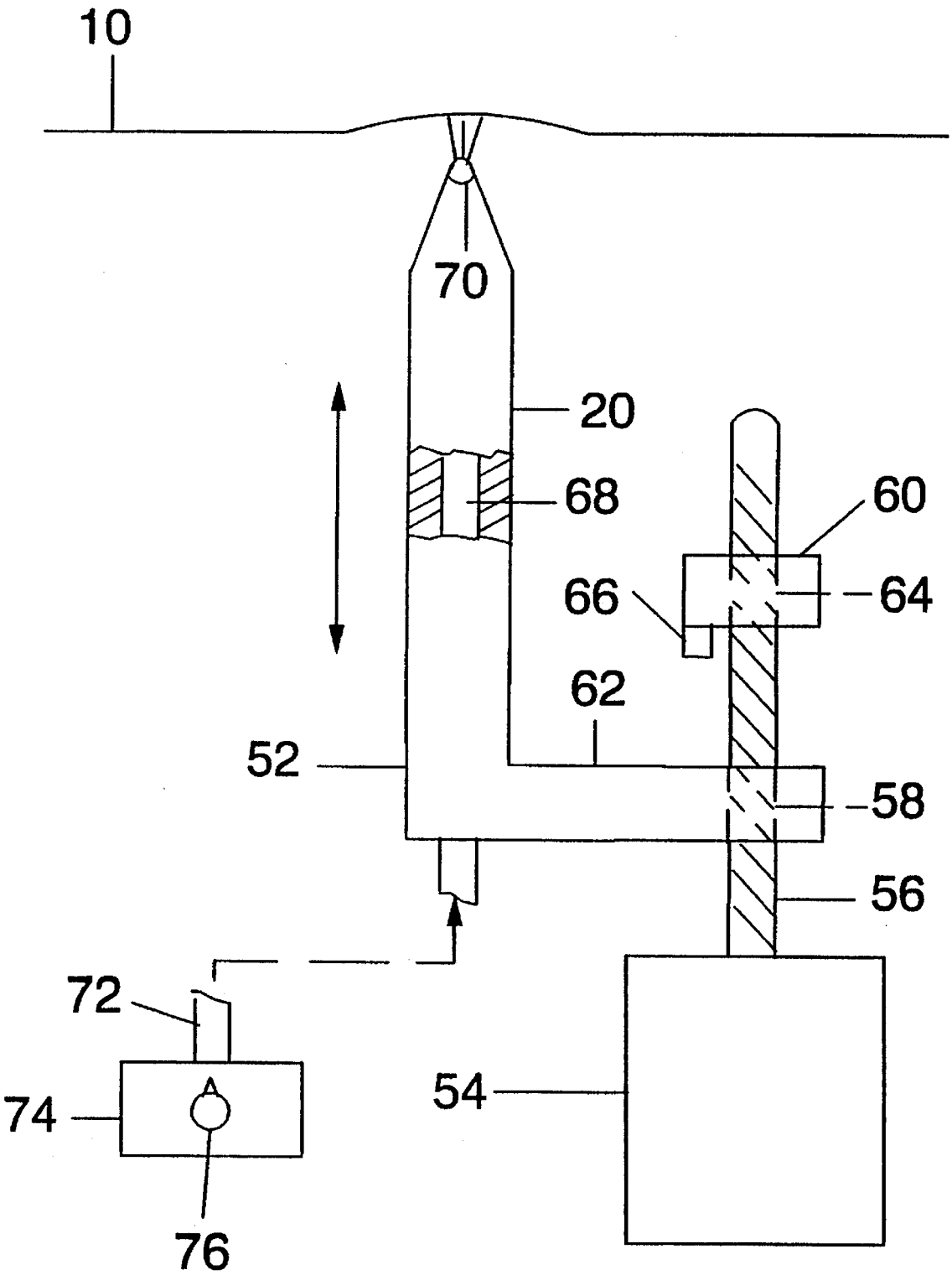
FIG. 4 is an elevational view of an air nozzle for making corrections to the web of the system of FIG. 2.

Another embodiment of the pressure member 20 is illustrated in FIG. 4, in which like reference numerals designate like parts. In this embodiment, the pressure member 20 has a suitable stepping motor 54 with a rotatably driven threaded shaft 56 received in a threaded bore 64 of a support member 60, as previously described. The pressure member 20 has a retaining member 52 having a threaded bore 58 to receive the threaded shaft 56, thus causing linear movement of the retaining member 52 in opposite directions along the shaft 56 depending upon the direction of rotation of the shaft 56 by the stepping motor 54.

As shown, the retaining member 52 has a channel 68 communicating with a nozzle 70 at one end of the retaining member 52 for passing a suitable fluid, such as air onto a surface of the web 10. The pressure member 20 of this embodiment has a conduit 72 connected to a supply 74 of compressed air, such that the air is passed from the supply 74 through the channel 68 of the retaining member 52, and through the nozzle 70 onto the web 10. The pressure of the fluid from the supply 74 may be modified by a suitable control 76 associated with the supply 74. In this manner, a desired pressurized stream of air may be directed through the nozzle 70 onto the web 10, and a plurality of these pressure members 20 may be located across the width of the web 10, if desired, in order to shorten the width of the web 10 a desired amount, such as from the distance L' to the distance L, as discussed in connection with FIG. 1. In addition, the distance of the nozzle 70 relative to the web 10 may be controlled by the motor 54 through suitable rotation of the shaft 56, thus moving the nozzle 70 towards and away from the web 10, such that the distance between the nozzle 70 and web 10 also controls the reduction in width of the web 10 in order to prevent misregistration of the web 10.

Figure 5:
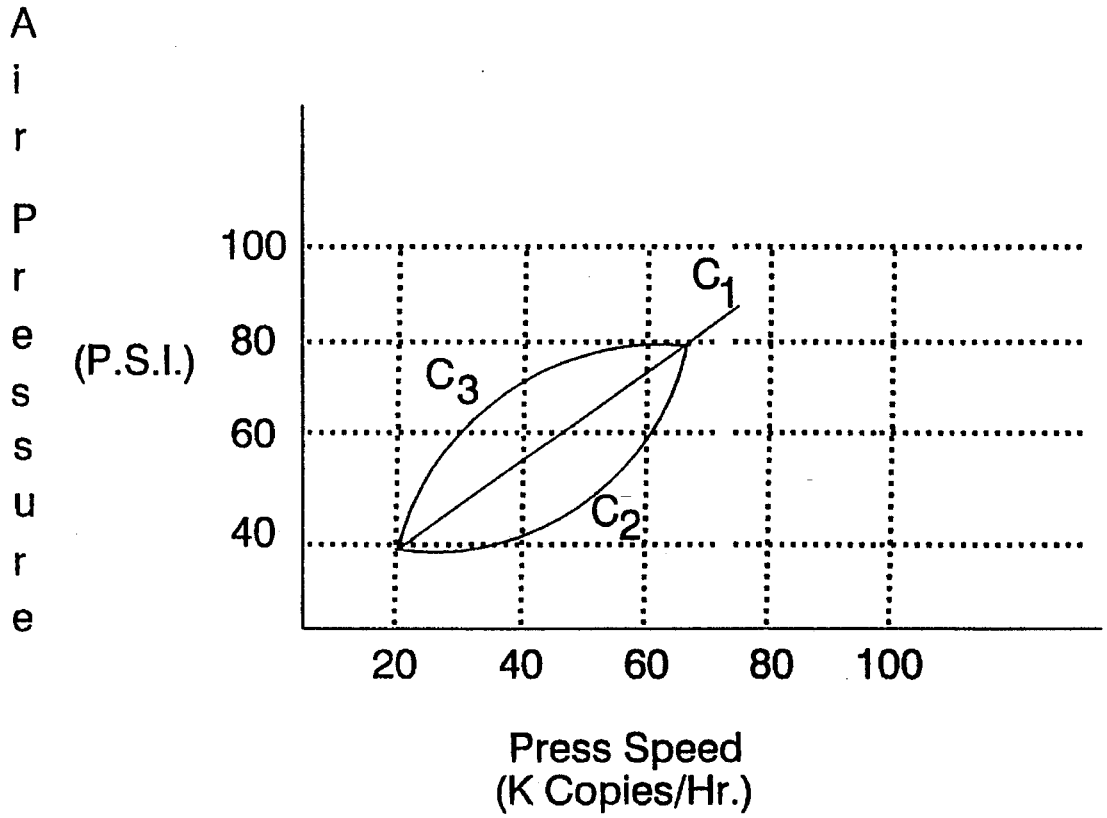
FIG. 5 is a graph showing the dependence of air pressure of the nozzle as a function of the speed of the press.
Figure 8:
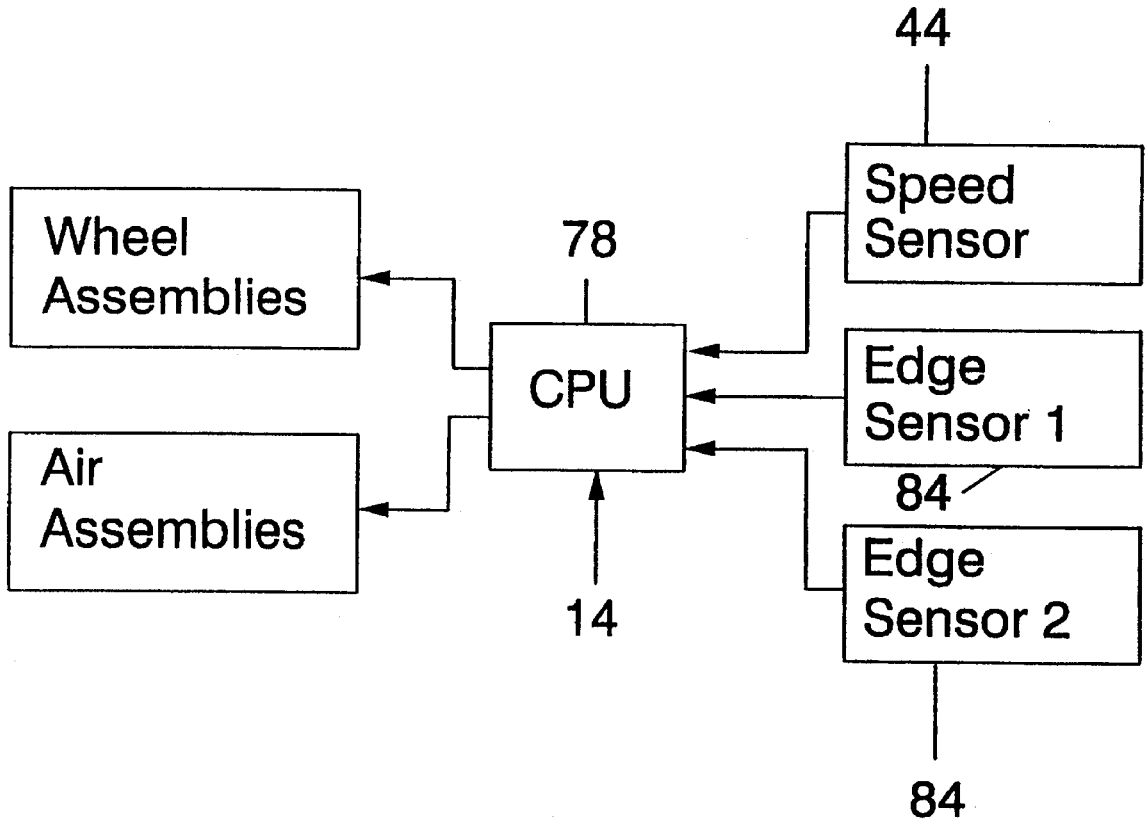
FIG. 8 is a block diagram of the control system of the present invention.

A chart plotting Air Pressure against Press Speed is shown in FIG. 5. The press speed may be determined by the speed sensor 44 in FIG. 1, or by other suitable means. The signal from the speed sensor 44 is electrically connected to a computer 78 or Central Processing Unit (CPU) having a read only memory (ROM) and random access memory (RAM), as shown in FIG. 8. With further reference to FIG. 5, the air pressure which is required to correct the width of the web 10 varies with the press speed, with three different representative curves $C_1$, $C_2$, and $C_3$ being shown. Thus, when the press speed is determined by the sensor 44, and supplied to the CPU, the CPU may change the air pressure supplied by the nozzle 70 against the web 10 a desired amount, such as indicated by the chart of FIG. 5. Values for the different air pressures may be retained in the memory of the computer 78, such that the desired air pressures correspond to values of the press speed., e.g., such as in look up table in the memory of the computer 78. In this manner, the CPU may control the air pressure, and may also move the nozzle 70 towards or away from the web 10 to modify pressure, depending upon the press speed, as shown in conjunction with FIG. 8.

Figure 6:
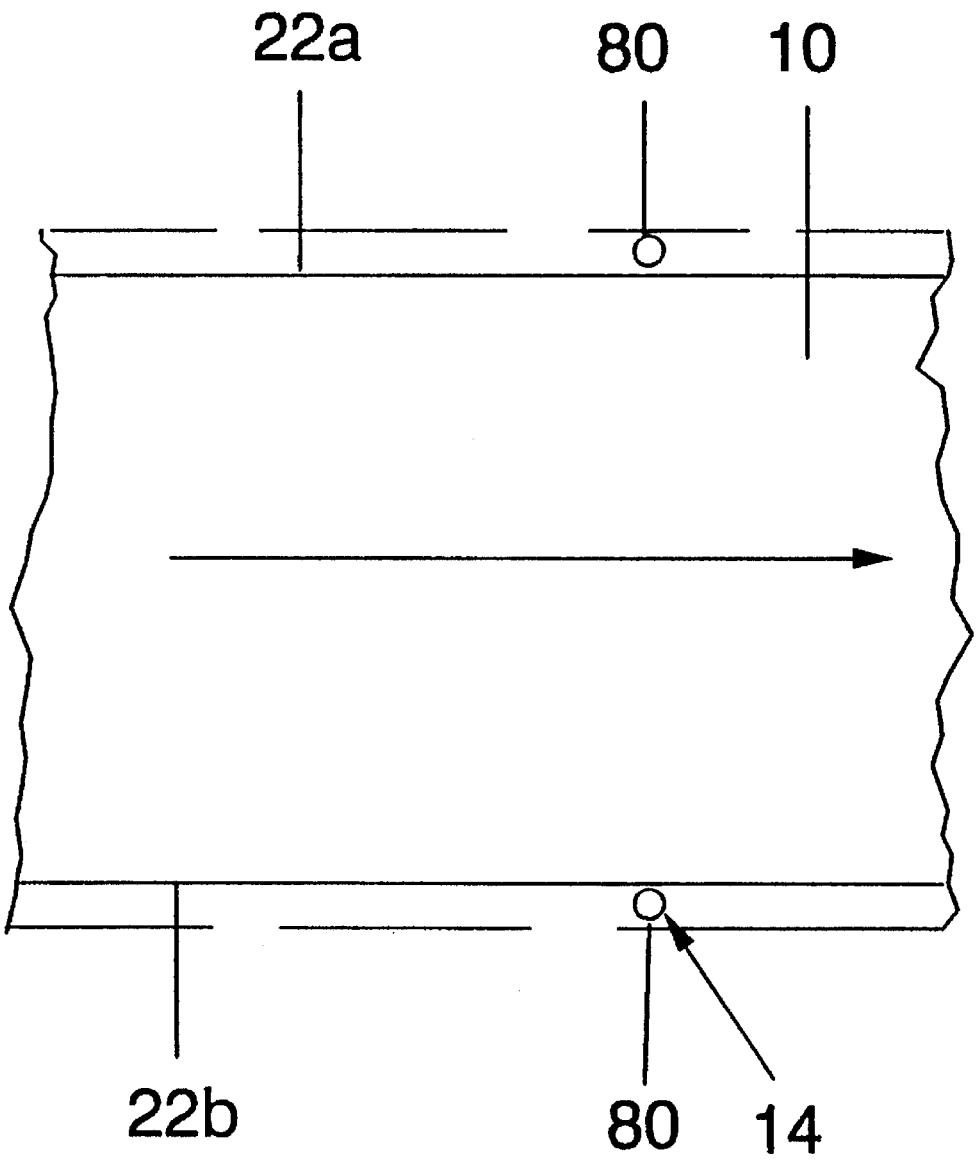
FIG. 6 is a plan view of the relationship between sensors and the web to provide an automatic control system of the present invention.
Figure 7:
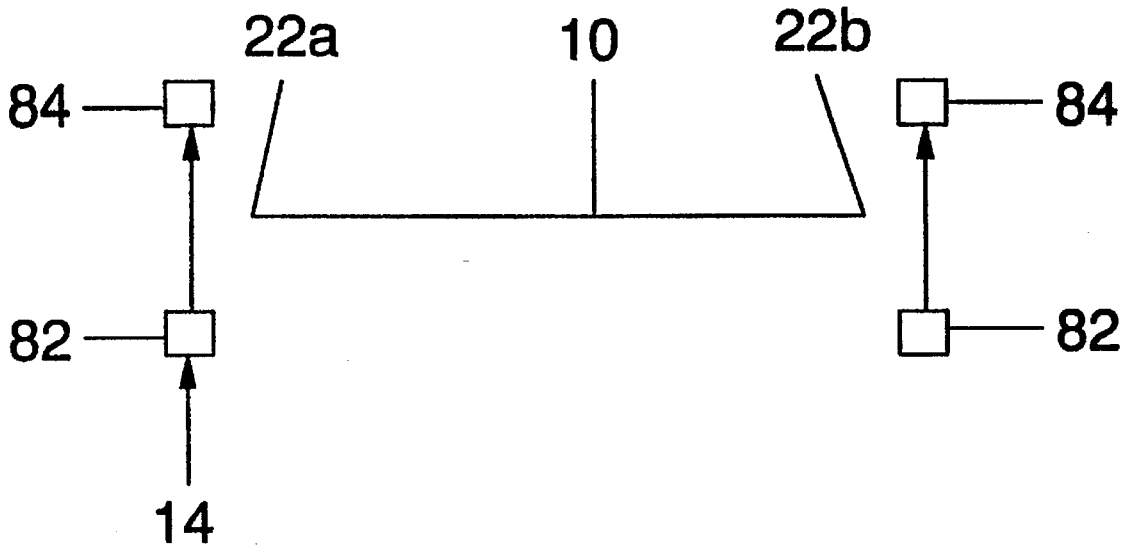
FIG. 7 is an elevational view of the system of FIG. 6.

An automatic control system 14 for the press 12 is illustrated in FIGS. 6–8, in which like reference numerals designate like parts. As shown in FIGS. 6 and 7, the system 14 has a pair of sensing assemblies 80 located adjacent the opposed side edges **22*a* and *b* of the web 10. As shown in FIG. 7, each of the sensor assemblies 80 has a light emitter 82 which directs light towards an associated sensor 84, with the emitter 82 and sensor 84 being located on opposed sides of the web 10. When the edge of the web 10 interrupts the light supplied to the sensor 84, a signal is transmitted to the CPU in order to indicate a fan out condition of the web 10, such as due to moisture applied to the web 10, as previously discussed. Under this condition, either one or both edges of the web 10 may interrupt either one or both of the sensors 84, which condition is indicated to the CPU, as shown in FIG. 8**.

In turn, the CPU directs a modification in the position of the wheel 48, the pressure of the air stream through the nozzle 70, or the position of the nozzle 70 relative to the web 10 in order to correct the lateral dimensions of the web 10 through control of one or more of the pressure members 20. Once the web has been corrected a sufficient amount, the edges of the web 10 will become spaced inwardly from the sensors 84, thus indicating by the absence of a signal from the sensors 84 to the CPU that the lateral dimensions of the web 10 are in a desired condition to prevent misregistration of the web 10.

In this manner, an automatic control system 14 is provided to sense the locations of the side edges of the web 10, and correct the lateral dimensions of the web 10 in an automatic manner. Thus, the system 14 of the present invention simplifies adjustment of the web 10, and eliminates the tedious adjustments and down time previously required by the press 12.

Figure 9:
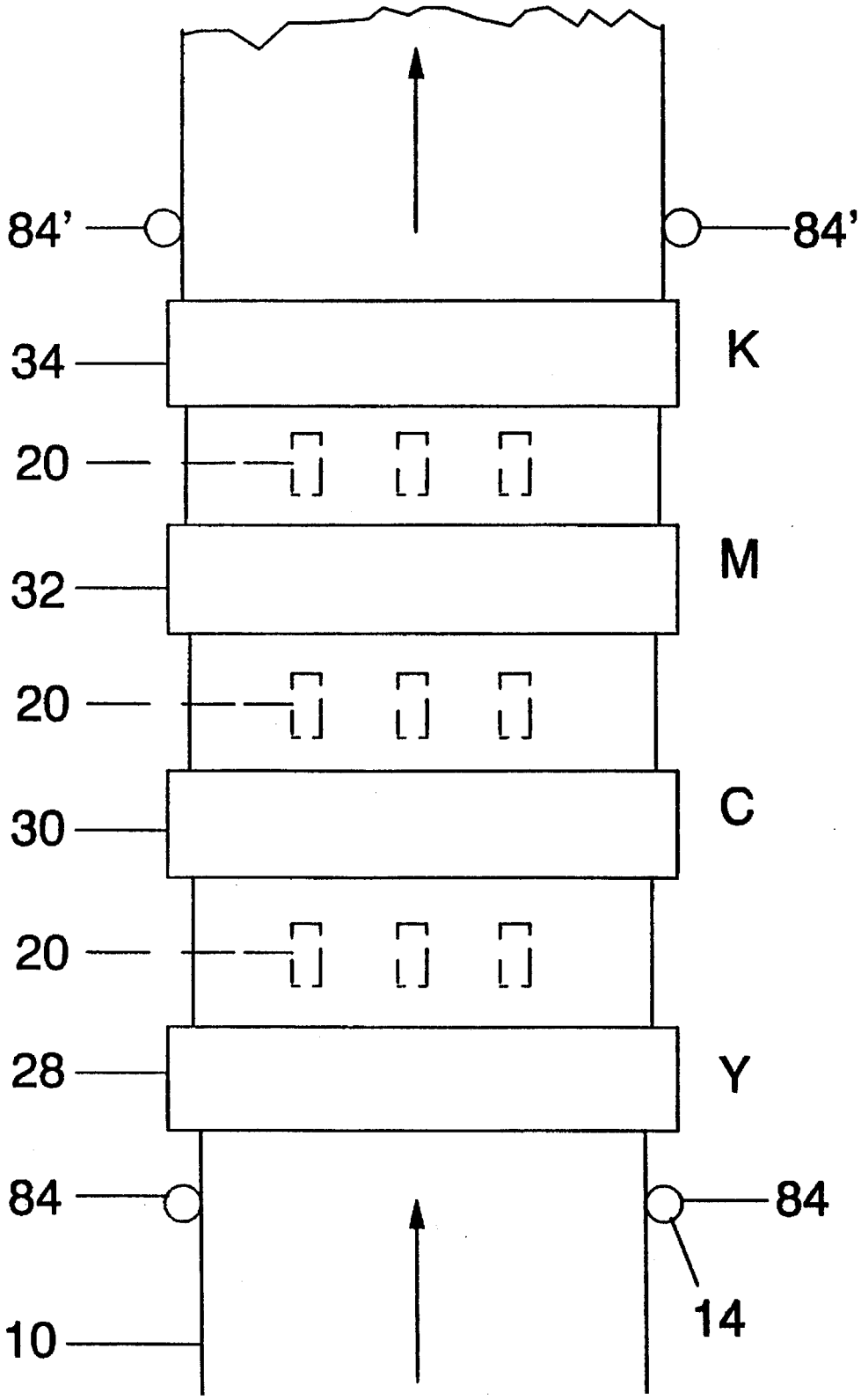
FIG. 9 is a diagrammatic view of another embodiment of the control system of the present invention.

Another embodiment of the present invention is illustrated in FIG. 9, in which like reference numerals designate like parts. In this embodiment, the system 14 has a first set of sensors 84 located at the opposed edges 22*a* and *b* of the web 10 in order to monitor the web 10 in its dry condition. Thus, the sensors 84 measure the side edges 22*a* and *b* before the web 10 passes to the printing units 28, 30, 32, and 34. Another set of sensors 84' are positioned adjacent the side edges 22*a* and *b* after the web 10 passes from the last printing unit 34, such that the sensors 84' measure the web 10 in its moistened condition after printing in order to determine the two differences between the dry and moistened web width Delta s1 and Delta s2 adjacent both side edges of the web 10. Of course, the sensors 84 and 84' all have suitable light emitters associated with the sensors 84 and 84', as previously described. The measured sum Delta S1 and Delta S2 is then utilized by the CPU to control the pressure members 20 in order to reduce the width of the moistened web 10 by the system 14, with the pressure members 20 being located between one or more than one of the printing units 28, 30, 32, and 34, as shown. Thus, the system 14 controls the width of the web in an automatic manner.

The foregoing detailed description has been given for clearness of understanding only, and no unnecessary limitations should be understood therefrom, as modifications will be obvious to those skilled in the art.

What is claimed is:

1. A control system for a web in a printing press, comprising:

at least one printing unit for printing the web;

first means for determining the lateral location of at least one edge of the web prior to passage of the web to said printing unit;

second means for determining the lateral location of at least the same one edge of the web as determined by the first determining means after passage of the web from the printing unit, said second determining means being longitudinally spaced from the first determining means along the web; and means responsive to the first and second determining means for applying pressure against a surface of the web at a location spaced inwardly from opposed side edges of the web to modify the effective width of the web by deflecting a portion of the web spaced inwardly from opposed side edges of the web.

2. The system of claim 1 including a plurality of printing units.

3. The system of claim 2 wherein the pressure applying means comprises a plurality of pressure members located between the printing units.

4. The system of claim 1 wherein the first and second determining means comprises a pair of sensors on both sides of the web before the web passes to the printing unit, and after the web passes from the printing unit.

* * * * *